US010966011B2

(12) United States Patent
Mennitt

(10) Patent No.: US 10,966,011 B2
(45) Date of Patent: Mar. 30, 2021

(54) ADAPTIVE COUPLER FOR CALIBRATION OF ARBITRARILY SHAPED MICROPHONES

(71) Applicant: Colorado State University Research Foundation, Fort Collins, CO (US)

(72) Inventor: Daniel J. Mennitt, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 162 days.

(21) Appl. No.: 16/390,965

(22) Filed: Apr. 22, 2019

(65) Prior Publication Data

US 2019/0394550 A1 Dec. 26, 2019

Related U.S. Application Data

(60) Provisional application No. 62/688,135, filed on Jun. 21, 2018.

(51) Int. Cl.
*H04R 29/00* (2006.01)
*H04R 1/08* (2006.01)
(Continued)

(52) U.S. Cl.
CPC ..... *H04R 1/083* (2013.01); *H04R 3/005* (2013.01); *H04R 25/30* (2013.01); *H04R 25/305* (2013.01);
(Continued)

(58) Field of Classification Search
CPC ..... H04R 1/083; H04R 3/005; H04R 25/30; H04R 25/305; H04R 29/004; H04R 29/005; H05R 25/70; H04S 7/301
(Continued)

(56) References Cited

U.S. PATENT DOCUMENTS 4,586,194 A * 4/1986 Kohashi ..... H04R 29/001 381/60
5,105,822 A * 4/1992 Stevens ..... A61B 5/12 600/559
(Continued)

OTHER PUBLICATIONS

American National Standard. Measurement Microphones, Part 2: Primary Method for Pressure Calibration of Laboratory Standard Microphones by the Reciprocity Technique. ANSI/ASA (2005) S1.15—2005, 1-49.
(Continued)

*Primary Examiner* — Huyen D Le
(74) *Attorney, Agent, or Firm* — Meunier Carlin & Curfman LLC

(57) ABSTRACT

Accurate measurements of the sound pressure level require regular calibration of the microphone. Closed-coupler calibration devices are designed to work with laboratory and working standard microphones, but there are numerous microphones with dimensions that do not fit a standard coupler. For example, micro-electro-mechanical system microphones are very small and widely used due to their size, performance, and cost. Described herein is an acoustical coupler that can accommodate microphones of arbitrary cross-sectional shape. The coupler utilizes a flexible membrane that adapts to the shape of the microphone. In contrast to a rigid enclosure, the permeability of the membrane creates an open system that reduces the sensitivity to fit. The precision and accuracy of the device is demonstrated by calibrating a small, oddly shaped microphone using the substitution method.

20 Claims, 7 Drawing Sheets

(51) Int. Cl.
*H04S 7/00* (2006.01)
*H04R 3/00* (2006.01)
*H04R 25/00* (2006.01)

(52) U.S. Cl.
CPC ..... *H04R 25/70* (2013.01); *H04R 29/004* (2013.01); *H04R 29/005* (2013.01); *H04S 7/301* (2013.01)

(58) Field of Classification Search
USPC ..... 381/60, 355
See application file for complete search history.

(56) References Cited

U.S. PATENT DOCUMENTS 6,687,377 B2 * 2/2004 Voix ..... A61F 11/08 381/60
2007/0009107 A1 * 1/2007 Lange ..... H04R 25/305 381/60

OTHER PUBLICATIONS

American National Standard. Specifications and Verification Procedures for Sound Calibrators. ANSI/ASA (2006) S1.40—2006. Abstract.
American National Standard. Specifications for Octave-Band and Fractional-Octave-Band Analog and Digital Filters. ANSI/ASA (2009) S1.11—2004.
American National Standard. Specifications for Sound Level Meters. ANSI/ASA (2006) S1.4—2006.
B. Zhou, D.M. Green, J.C. Middlebrooks. Characterization of external ear impulse responses using Golay codes. J Acoust Soc Am, 92 (2) (1992), pp. 1169-1171.
B.D. Simmons, F. Biagi. Pressure calibration of condenser microphones above 10 000 cps. J Acoust Soc Am, 26 (5) (1954), pp. 693-695.
C.A. Kardous, P.B. Shaw. Evaluation of smartphone sound measurement applications (apps) using external microphones—A follow-up study. J Acoust Soc Am, 140 (4) (2016), pp. 327-333.
D.J. Mennitt, K.M. Fristrup, B.M. Notaros Characterization of gain and directivity of exponential horn receivers. J Acoust Soc Am, 142 (5) (2017), pp. 3257-3266.
D.J. Mennitt, K.M. Fristrup. Obtaining calibrated sound pressure levels from consumer digital audio recorders. Appl Acoust, 73 (2012), pp. 1138-1145.
E. Frederiksen. Acoustic metrology—an overview of calibration methods and their uncertainties. Int J Metrol Qual Eng, 4 (2) (2013), pp. 97-107.
IEC standard 60268-4, Sound system equipment Part 4: Microphones (International Electrotechnical Commission, 2004), 8 pages.
International Electrotechnical Commission. Sound System Equipment, Part 4: Microphones IEC Standard (2004) 60268-4, 54 pages.
J. Shonfield, E. Bayne. Autonomous recording units in avian ecological research: current use and future applications. Avian Consery Ecol, 12 (1) (2017), 13 pages.
K.M. Fristrup, D. Mennitt. Bioacoustical monitoring in terrestrial environments. Acoust Today, 8 (3) (2012), pp. 16-24.
M. Vorländer. Acoustic Measurements. G. Müller, M. Möser (Eds.), Handbook of engineering acoustics (Chapter 2), Springer-Verlag, Berlin Heidelberg (2013), 23-52. Revised Relation between the Sound Power and the Average Sound Pressure Level in Rooms and Consequences for Acoustic Measurements. Acta Acustica united with Acustica, vol. 81, No. 4, Jul. 1, 1995, pp. 332-343(12).
N.P. Miller. US National Parks and management of park soundscapes: a review. Appl Acoust, 69 (2) (2008), pp. 77-92.
New Method of Measuring Reverberation Time [M. R. Schroeder, J. Acoust. Soc. Am. 37, 409-412 (1965)].
R.P. Wagner, S.E. Fick. Pressure reciprocity calibration of a MEMS microphone. J Acoust Soc Am, 142 (3) (2017) EL251-EL257.
Sonion Microphone 6297 Data Sheet. (Oct. 31, 2007). Retrieved from http://www.sonion.com/wp/wp-content/uploads/6297-3013585.pdf.
V. Nedzelnitsky. Calibration of pressure and gradient microphones. M.J. Crocker (Ed.), Encyclopedia of acoustics (Chapter 157), John Wiley & Sons (1997), 11 pages.
W.O. Hughes, A.M. McNelis, C. Nottoli, E. Wolfram. Examination of the Measurement of Absorption Using the Reverberant Room Method for Highly Absorptive Acoustic Foam. NASA Technical Report 29th Aerospace Testing Seminar (2015) Oct. 2015, 27 pages.

* cited by examiner 100
110
108
102

104
Length
116
108
114
118
102
102
106
112

104
120
108
108
Distance
122
118
102
102
106
112

ADAPTIVE COUPLER FOR CALIBRATION OF ARBITRARILY SHAPED MICROPHONES

CROSS-REFERENCE TO RELATED APPLICATION

This application claims priority to and benefit of U.S. provisional patent application Ser. No. 62/688,135 filed Jun. 21, 2018, which is fully incorporated by reference and made a part hereof.

GOVERNMENT SUPPORT CLAUSE

This invention was made with government support under grant P14AC00728 awarded by the Department of Interior, National Park Service. The government has certain rights in the invention.

FIELD OF THE INVENTION

The present disclosure relates to couplers for calibrating microphones and, more specifically, to an adaptive coupler for calibrating arbitrarily, oddly and/or irregularly shaped microphones.

BACKGROUND

Accurate acoustical measurements require regular calibration of the microphone. There are a great many calibration procedures of varying complexity, uncertainty, and cost to accommodate a wide variety of microphone types, characteristics, and applications. An acoustical coupler is a commonly used device for calibrating pressure microphones by both primary methods utilizing reciprocity and secondary methods utilizing comparison techniques. Closed-coupler devices for secondary comparison methods use a transducer to produce sound pressure in a cavity that is "closed" by the microphone i.e. the diaphragm forms part of the wall. The pistonphone is a common example in which a piston is mechanically driven to generate a sinusoidal pressure fluctuation within the cavity. Because the resulting sound pressure is dependent on the cavity volume, static pressure, and temperature in addition to piston displacement, it is sensitive to the fit of the microphone to the coupler walls. Variation in the quality of the seal leads to variation in received pressure, especially at low frequencies. The feedback calibrator, another closed-coupler device, partly addresses these issues by using the signal from an internal reference microphone to adjust the output of an electrodynamic loudspeaker, but an adapter must be used to reliably match the microphone to the coupler orifice.

Couplers and adapters are designed to be used with laboratory and working standard microphones which are generally cylindrical in shape and have a diameter of approximately 23.77 mm, 12.7 mm, or 6.35 mm. However, there are many situations in which a microphone does not fit a standard coupler. The use of a ruggedized environmental housing or housing with attractive acoustical properties can result in a shape that disturbs the fit to a coupler. Furthermore, there are numerous microphones with dimensions other than that of standard microphones. For example, micro-electro-mechanical system (MEMS) microphones are very small and widely used due to their size, performance, and cost. These and other consumer microphones have been increasingly used in measurement applications and the cost of such equipment is attractive, especially for studies entailing large-scale spatial sampling. Relative to standard microphones, consumer microphones are typically less robust to changing environmental conditions and require more frequent calibration. Alternative systems to accommodate the physical dimensions of a microphone are not uncommon and custom adapters can be machined for a particular coupler and microphone geometry with considerable effort. Alternatively, the free-field response of a microphone can be assessed with an anechoic chamber. However, anechoic chambers are expensive and the lower the frequency, the more difficult it is to create a sufficiently anechoic space. Calibration by an electrostatic actuator is only possible for microphones with an accessible metallized diaphragm.

Therefore, a need exists to address challenges in the art, some of which are described above.

SUMMARY

Described herein are embodiments of an "adaptive" coupler that can accommodate a microphone of arbitrary cross-sectional shape and size. The microphone port of the adaptive coupler is a flexible membrane that adapts to the shape of the microphone. In one aspect, the flexible membrane comprises open-cell foam. Open-cell foam does not completely adapt to shape of a microphone, but the permeability of open cell foam creates an open system which mitigates the imperfection of the seal. As noted above, typical acoustical couplers constitute a closed system. In contrast, an open system freely exchanges matter with its surroundings. The permeability of a membrane made of open cell foam creates an open system, which is less sensitive to the seal between the microphone and coupler and relaxes the sensitivity to radiation loading. Instead of relying on precise parameters describing the cavity and microphones, an interior space is excited with a sound source and the pressure at the face of the membrane is measured with a reference microphone for use with a direct comparison calibration method. In some embodiments, the interior cavity of the coupler is also at least partially lined with sound absorbing materials to dissipate energy at high frequencies. Damping increases the density of cavity modes, lowering the frequency at which acoustic field becomes diffuse. The small size and damping reduces the effects of wave motion on the received pressure at low and high frequencies respectively.

Also described herein are the physical structures of embodiments of the system coupler and associated calibration methods. Acoustical signal processing is exploited to overcome the greater susceptibility to outside interference of an open system relative to a rigid walled enclosure. For context, a generalized system framework for the transduction of acoustical signals is described that can be used to both calculate the sensitivity of a microphone using the substitution method as well as apply the known sensitivity of system elements to resolve the sound pressure level of a field measurement. The acoustical properties of the adaptive coupler are also described herein. An example calibration of a small, oddly shaped mic and the associated uncertainty is also described.

The foregoing illustrative summary, as well as other exemplary objectives and/or advantages of the disclosure, and the manner in which the same are accomplished, are further explained within the following detailed description and its accompanying drawings.

Other systems, methods, features, and/or advantages will be or may become apparent to one with skill in the art upon examination of the following drawings and detailed description. It is intended that all such additional systems, methods, features and/or advantages be included within this description and be protected by the accompanying claims.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

BRIEF DESCRIPTION OF THE DRAWINGS

Figures

DETAILED DESCRIPTION

Figures 1A, 1B, 1C:
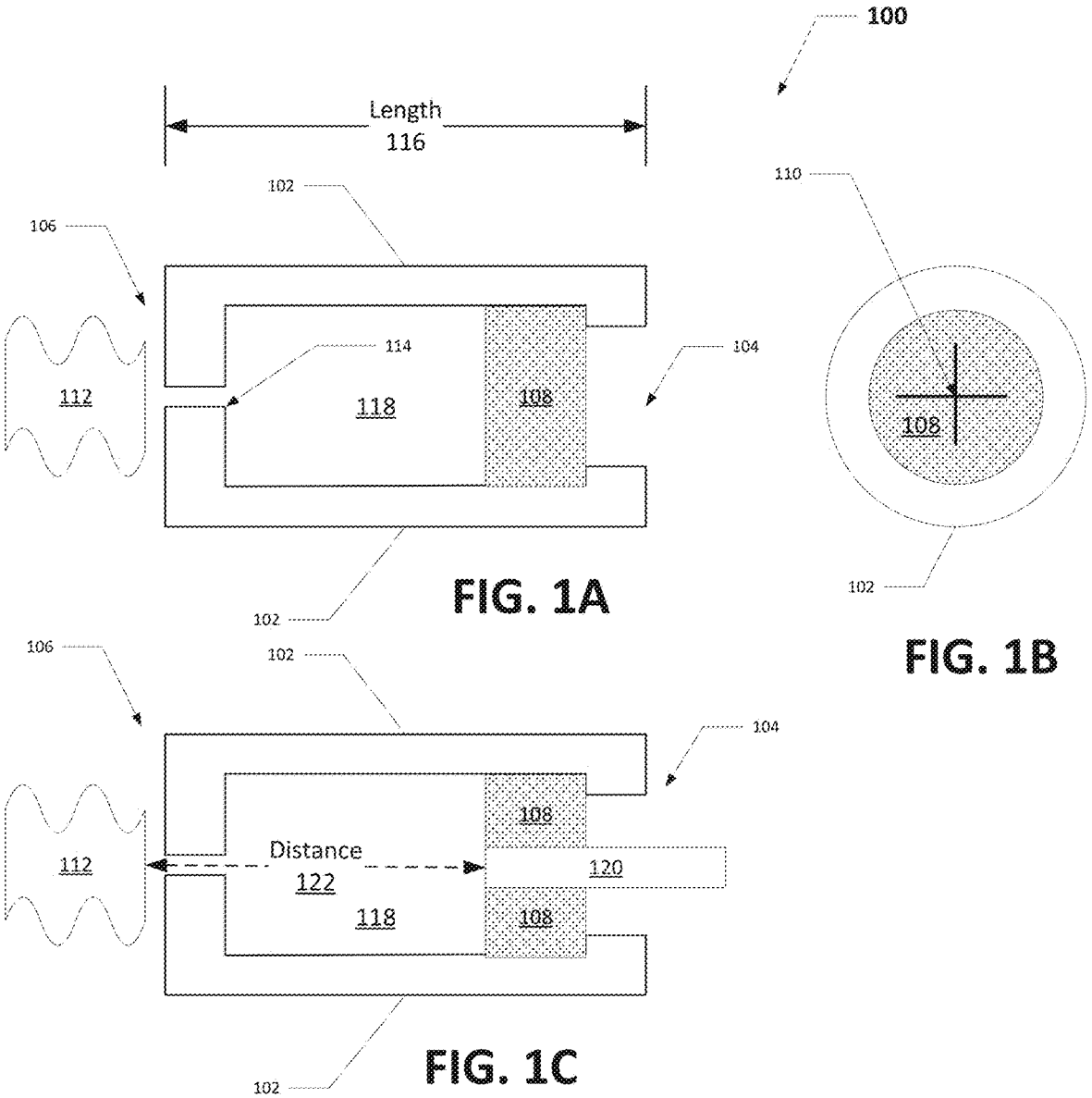
(FIGS. 1A, 1B, and 1C illustrate schematics of an embodiment of an adaptive coupler as described herein.

FIGS. 1A and 1B illustrates a schematic of an embodiment of an adaptive system coupler described herein. Other configurations are possible; as the size and shape can be varied in regard to both the performance of the device and the size of microphone it can accommodate. FIGS. 1A and 1B are orthographic drawings of the exemplary adaptive coupler showing a center cutaway of the side view (FIG. 1A) and front view (FIG. 1B).

FIGS. 1A and 1B illustrate an adaptive coupler 100 for calibration of arbitrarily shaped microphones. As used herein, irregular, oddly-shaped or arbitrarily-shaped anything besides a cylinder of diameter 23.77 mm, 12.7 mm, or 6.35 mm. However, it is to be appreciated that the embodiments described herein can also be used to calibrate microphones of 'regular' shape and size. The embodiment of an adaptive coupler shown in FIGS. 1A and 1B comprises a rigid structure 102 having a proximal end 104 and a distal end 106. At least a portion of the rigid structure is hollow. Further comprising the embodiment of FIGS. 1A and 1B is a flexible membrane 108 located within the proximal end 104 of the rigid structure 102. The flexible membrane 108 adapts to a shape of a microphone inserted into an opening 110 in the flexible membrane 108. When the microphone is inserted into the opening 110 of the flexible membrane 108, at least a portion of the microphone is exposed to the hollow portion of the rigid structure 102. Generally, the diaphragm of the microphone will be flush with an inside surface (closest to or facing the hollow portion of the rigid structure 102) of the flexible membrane 108. Generally, the flexible membrane 108 comprises any adaptive material including materials that may be air-permeable and materials that are not air-permeable. For example, the flexible membrane 108 may comprise open-cell foam, closed-cell foam, fiberglass, rubber, rubber-like materials, neoprene, etc.

The rigid structure 102 is configured to receive sound pressure 112. For example, as shown in FIG. 1A, the distal end 106 is configured to receive sound pressure 112 from a sound source (not shown in FIGS. 1A and 1B). The rigid structure 102 can have any shape including, for example, round, oval, square, rectangular, triangular, polygonal, etc. in cross-sectional shape. The rigid structure may be comprised of any suitable material including, for example, one or more of plastic, metal, glass, fiberglass, rubber, bamboo, wood, and the like. As shown in FIG. 1A, the distal end 106 of the rigid structure 102 has at least one opening 114 to receive the sound pressure 112 from the sound source.

As shown with respect to FIG. 1A, the rigid structure 102 has a length 116. The length 116 forms a space 118 between the flexible membrane 108 and the distal end 106. In FIG. 1A, the space 118 is a gas-filled space. The gas that fills the space 118 can be any suitable gas including air, oxygen, helium, etc., or combinations of gasses. In other embodiments, the space 118 can be at least partially filled with a material. The material used to at least partially-fill the space 118 may be a sound-absorbing material. In some instances, the material may be the same material that comprises the flexible membrane 108. For example, the material may be open-cell foam, closed-cell foam, rubber, rubber-like materials, neoprene, fiberglass, etc.

FIG. 1C illustrates the adaptive coupler of FIGS. 1A and 1B, with a microphone 120 inserted into the opening 110 in the flexible membrane 108 such that a distance 122 is formed between an end of the microphone 120 and the sound source, said distance 122 being less than or equal to the length 116.

Figures 2A, 2B, 2C, 2D, 2E:
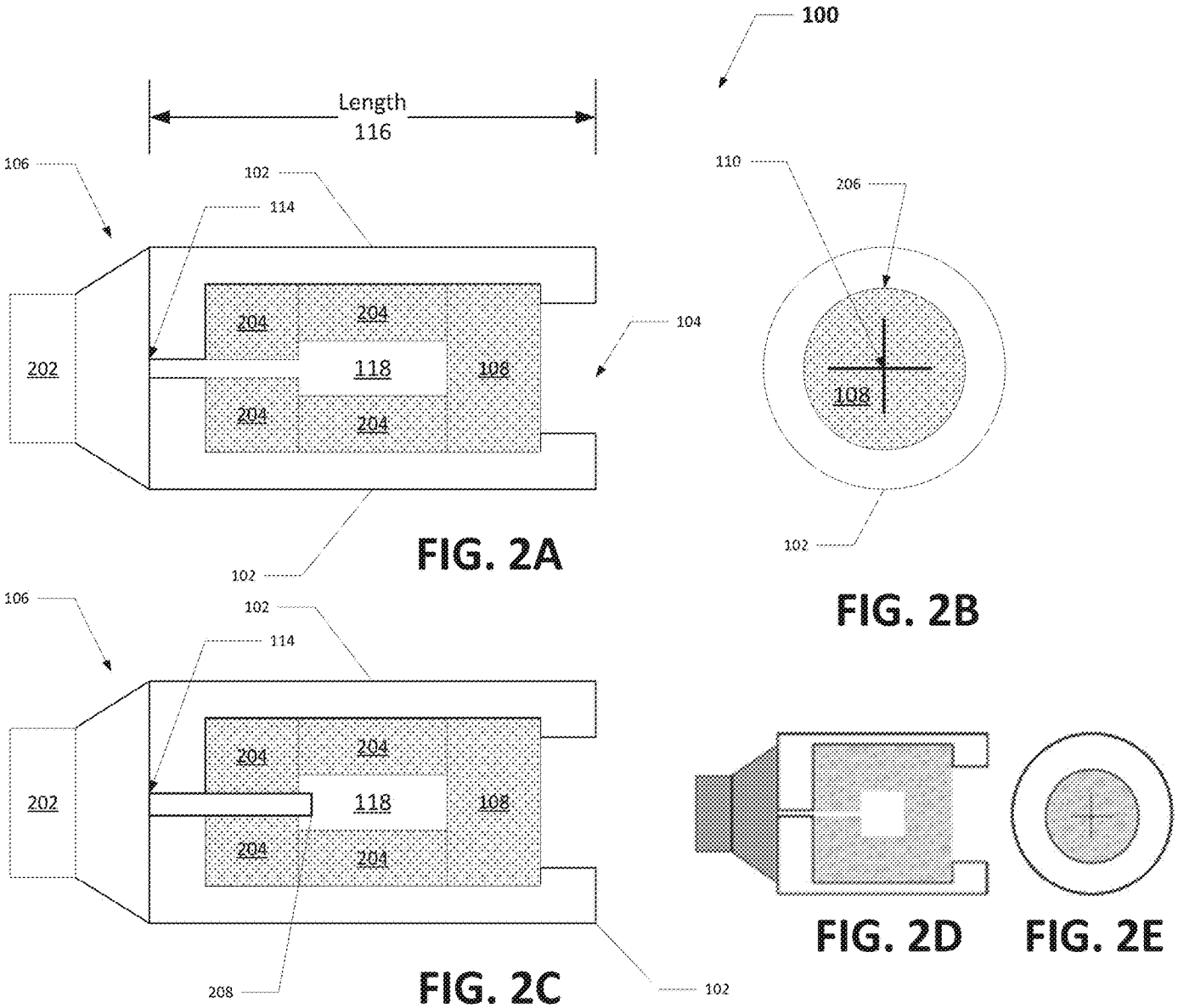
FIGS. 2A and 2B illustrate an alternate embodiment of an adaptive coupler.
FIG. 2C is yet another embodiment of an adaptive coupler.
FIGS. 2D and 2E are orthographic drawings of an embodiment of the adaptive coupler showing a center cutaway of the side view (FIG. 2D) and front view (FIG. 2E).

FIGS. 2A and 2B illustrate an alternate embodiment of an adaptive coupler 100. In this embodiment a sound source 202 is attached to the distal end 106 of the rigid structure 102. For example, the sound source 202 can be attached to the distal end using glue, tape, screws, latches, compression fit, or any other form of fastening the sound source 202 to the distal end 106. The sound source 202 may be any device that can create sound pressure 112 including, for example, a loud speaker, an electrodynamic loudspeaker, a piezo electric source, an electrostatic source, a spark source, mechanically driven piston, and the like. Also in the embodiment shown in FIG. 2A, the space 118 is at least partially-filled with sound-absorbing material 204, as described above.

As can be seen in the adaptive coupler of any of FIGS. 1A, 1B, 1C, 2A and 2B, the rigid structure 102 has a cross-sectional area, and the distal end 106 of the rigid structure 102 is configured to receive sound pressure 112 from the sound source 202. Generally, the sound pressure 112 will enter the rigid structure 102 through an opening 114 in the distal end 106, but it is contemplated that the sound pressure 112 may enter the rigid structure 102 from other entry points at one or more various other locations. The opening 114 generally has a cross-sectional area that is less than the cross-sectional area of the rigid structure 102. Furthermore, as can also be seen in these figures, the rigid structure 102 has a cross-sectional area, and the microphone 120 is inserted into the opening 110 in the flexible membrane 108 through an opening 206 in the proximal end 104 of the rigid structure 102. The opening 206 generally has a cross-sectional area that is less than the cross-sectional area of the rigid structure 102.

In some instances, referring to FIG. 2C, the adaptive coupler 100 may include a conduit 208, wherein the conduit extends from the sound source 202 into the space 118. In various aspects, the conduit 208 may have a diameter of any size suitable to transfer the sound pressure 112 into the space 118.

Figure 3A:
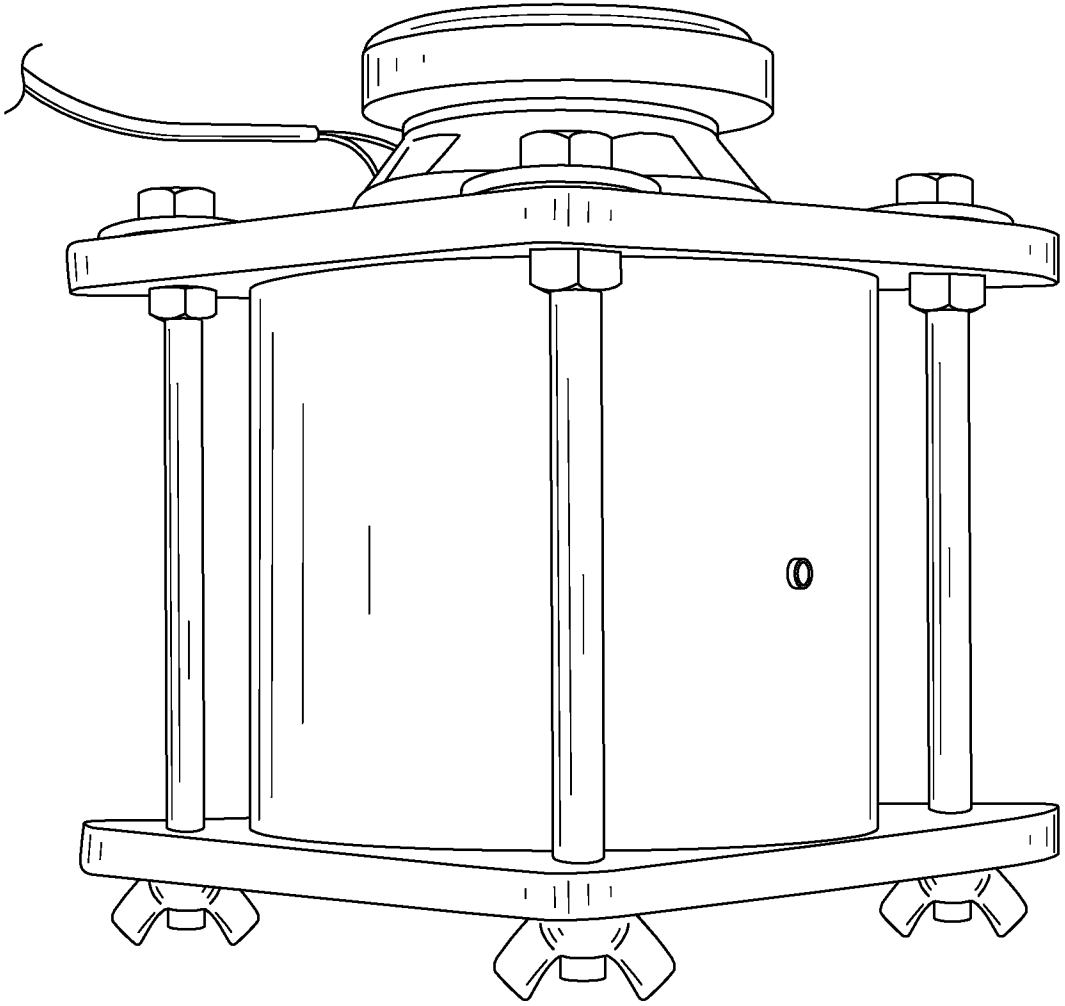
FIGS. 3A and 3B are illustrations of yet another embodiment of an adaptive coupler.
Figure 3B:
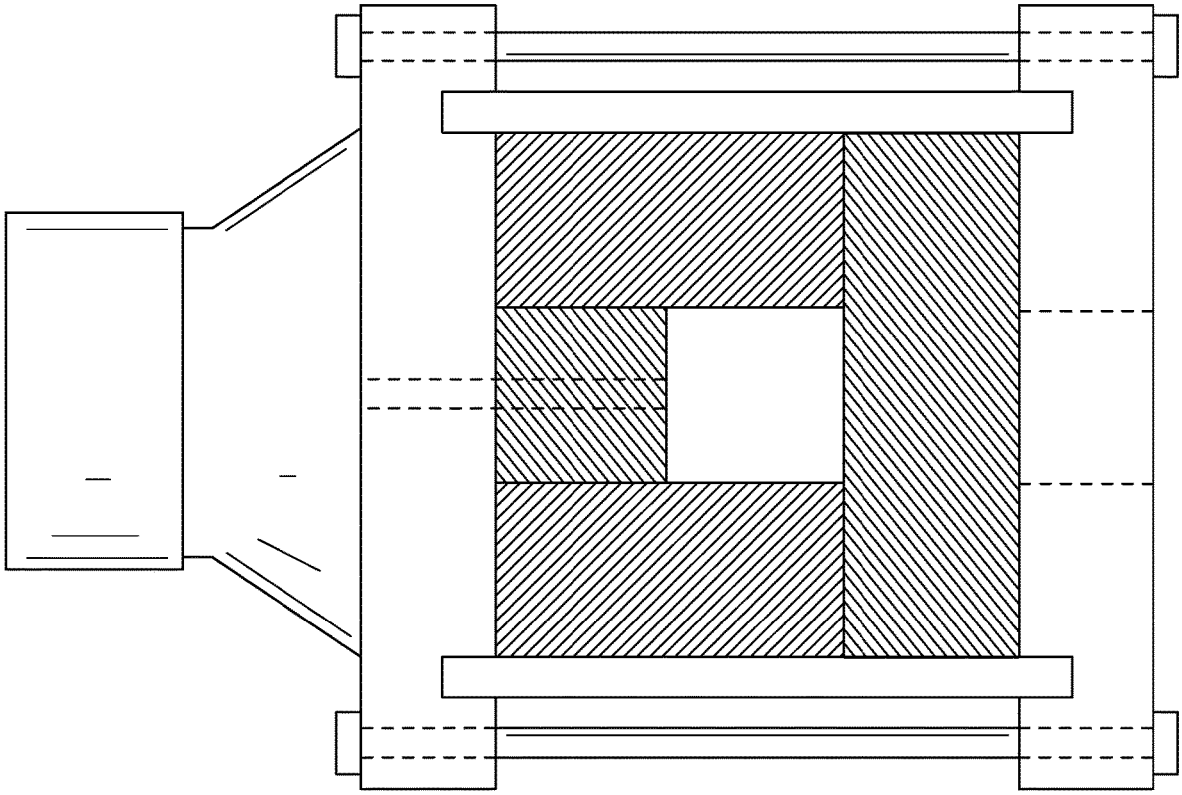

FIGS. 2D and 2E are yet another alternate embodiment of the adaptive coupler 100. FIGS. 3A and 3B are illustrations of yet another embodiment of an adaptive coupler.

In contrast to conventional "closed" couplers that comprise a rigid wall and orifice, the microphone port of the adaptive coupler 100 is comprised of the flexible membrane 108 of adaptive material (e.g., open cell foam), which adapts to the shape of the microphone. In one non-limiting example, the flexible membrane 108 comprises 2.54 cm thick melamine foam with two crosshatched incisions 110. Generally, the microphone 120 is inserted into the flexible membrane 108 until the diaphragm of the microphone 120 is flush with the interior surface of the flexible membrane 108, which compresses the flexible membrane 108 near the microphone 120. The absence of a rigid backing in the adaptive coupler 100 reduces the amount of reflected energy at low frequencies and venting through the membrane keeps the average pressure inside the cavity at approximately atmospheric pressure. At the distal end 106, the energy from the sound source 202 (e.g., an exterior mounted loudspeaker) is fed into the chamber by a narrow channel or conduit of approximately 3 mm diameter. Because comparison methods for calibration rely on the assumption that both the test and reference microphone are subject to the same excitation, the performance characteristics of the loudspeaker are not especially important. The radiation from the narrow conduit is more uniform with a smaller nearfield relative to the loudspeaker.

As shown in FIGS. 2A-2E, the other walls of the adaptive coupler 100 are rigid and covered with approximately 2.54 cm thick sound absorbing material (e.g., open cell foam) 204, leaving an interior space 118, cylindrical in shape with a diameter of approximately 2.54 cm and height of approximately 2.54 cm. The microphone 120 is coupled to the sound source 202 by this cavity 118. In a small cavity with linear dimensions much smaller than a wavelength, wave motion is insignificant and the acoustic pressure is distributed uniformly. To assess the sensitivity of a microphone, it is important that the sound pressure over the microphone diaphragm be as uniform as possible, although in practice this ideal condition can only be approximated. Large volume couplers are not as sensitive as plane wave couplers to the microphone equivalent volume, cavity volume, and other parameters, but wave motion is significant at lower frequencies. The threshold at which pressure is sufficiently uniform is dependent on characteristics of the microphone and coupler, but generally the largest linear dimension must be smaller than 1/10 of a wavelength.

At high frequencies, the sound-absorbing material 208 and/or the flexible membrane 108 damps the response of standing waves in the cavity. For example, the sound absorption coefficient of 2.54 cm thick melamine foam increases with frequency and is approximately 0.8 at 1 kHz. Damping increases the bandwidth of each resonance, and the frequency density of cavity modes overall. The cavity can be considered fairly diffuse above the Schroeder frequency, $f_s$, defined as:

$$f_s = 2000\sqrt{T/V} \quad (1)$$

where T is reverberation time and V is the volume. The small size and damping reduces the effects of wave motion on the received pressure at low and high frequencies respectively.

Microphone sensitivity is the relationship between the acoustical signal at the microphone diaphragm and the voltage signal at its electrical terminals. There are many measurement procedures of varying complexity, uncertainty, and cost to realize a given frequency range and accuracy and to accommodate a wide variety of microphone types, characteristics, and applications. The direct comparison, or substitution, method is a secondary calibration method in which the microphone to be measured (test) and a previously calibrated microphone are placed alternately at the same location in a controlled environment, either an acoustical coupler for pressure response or an anechoic chamber for free field response. First, the response of the reference mic to the source excitation is measured. Next, the test microphone is substituted in the position of the reference microphone and its response is measured. Last, the response of the reference mic to the source excitation is measured again to confirm the stability of the source. Each measurement contains source, cavity, microphone, and recording system characteristics; it is assumed that factors excluding microphone characteristics are common to both. Therefore, the sensitivity of the test microphone can be calculated from the ratio of the measured responses, the known sensitivity of the reference microphone, and consideration of any significant differences between the test and reference microphones. Secondary methods are naturally less accurate than primary methods; the reference microphone, previously calibrated by a primary method, calibrates the coupler which is then used as a transfer standard to calibrate the test microphone. Calibration by substitution is more accurate than simultaneous comparison.

Example Calibration of a Microphone

A loudspeaker provides flexibility in choice of many potential excitation signals. Golay complementary sequences were used as the source excitation signal. Because high-amplitude impulses are difficult to generate and averages are time consuming, digital sequences are an attractive alternative to rapidly probe an acoustical system. The autocorrelation of Golay complementary sequences is a delta function, and the power spectrum has identical bandwidth but differs with the length, L, of the sequence. Analysis is similar to a matched filter, and the increase in the signal to noise ratio of the Golay complementary sequences over a single impulse is $10 \log_{10}(2L)$. This is useful for practical applications because the adaptive coupler does not provide as much transmission loss as a sealed coupler. Although not necessary in quiet conditions, the increased signal-to-noise ration afforded by the use of Golay complementary sequences makes measurements more robust to outside interference. The output is the impulse response which provides a complete description of the system, temporal as well as spectral characteristics.

Figure 4:
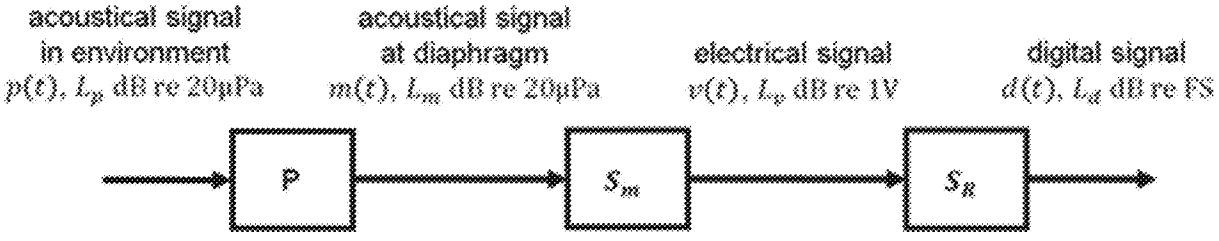
FIG. 4 is an illustration showing a chain of elements that affect and transduce the acoustical signal, where P represents propagation and accounts for how the equipment disturbs the field to be measured; $S_M$ is the microphone sensitivity; and $S_R$ is the sensitivity of the recording system.

Resolving a calibrated sound pressure level from a measurement requires consideration of all the elements in the system along the signal chain (see FIG. 4). The transfer function of each of these elements must be accounted for to determine the overall system sensitivity. Similarly, implementation of the substitution method uses the overall system sensitivity and other known elements to calculate the unknown microphone sensitivity.

Referring to FIG. 4, the time varying acoustic signal, p(t), may be affected by the measurement equipment itself such that the signal in the environment differs from the signal at the microphone diaphragm, m(t). The propagation element, P, is often influenced by factors such as a windscreen and scattering by the microphone and supporting hardware. Scattering effects are dependent on the wavelength of sound, direction of arrival, and physical dimensions of the microphone. The difference becomes significant at frequencies sufficiently high that a wavelength becomes comparable to or smaller than these dimensions, and microphones that account for the free-field response or random incidence response are commonly available. In contrast, acoustical couplers measure the pressure response of a microphone, the response of a microphone exposed to an undisturbed acoustic field.

The pressure signal at the microphone diaphragm, m(t), is transduced to an electrical signal, v(t), according to the frequency dependent sensitivity of the microphone, $$S_M = 10\log_{10}\frac{\langle v^2\rangle}{\langle m^2\rangle}\text{dB } re1\text{V/Pa} \tag{2}$$

where the ⟨⟩ symbol indicates a time-averaged (RMS) quantity. The sensitivity can be measured by calibration procedures described above, and varies with temperature, humidity, vibration, age, bias voltage, input impedance, and other factors.

Typically, the analog electrical signal is converted and recorded as a digital signal, d(t). The frequency dependent sensitivity of the recording element can be influenced by several factors such as a preamplifier, anti-aliasing filter, and analog to digital converter. The overall sensitivity of the recording element is $$S_R = 10\log_{10}\frac{\langle d^2\rangle}{\langle v^2\rangle}\text{dB } re1\text{/V} \tag{3}$$

$S_R$ is often easily measured by applying a known voltage signal to the recording system element. In digital audio using pulse-code modulation, bit depth is the number of bits of information in each sample which directly corresponds to the resolution of each sample. For example, 16 bits has 65,536 possible integer/discrete values per sample, which is often normalized to the range ±1. Expressed in decibels, $L_d=10\log_{10}\langle d^2\langle/\rangle d_{ref}^2\rangle$ dB in which the reference is 1. The units of $L_d$ are often notated dBFS for decibels referenced to full scale The level of the recorded digital signal, $L_d$, is equal to the sound pressure level, $L_p$, plus contributions from all the system elements along the signal chain, C. Therefore, $$L_p=L_d-C \tag{4}$$

where notation regarding the frequency dependency has been omitted. Referring to FIG. 4, the system calibration is $$C=P+S_m+S_R+R \tag{5}$$

where $R=10\log_{10}\langle p_{ref}^2\rangle/\langle d_{ref}^2\rangle=94$ dB. R accounts for the pressure and digital reference quantities such that C is unitless.

Figure 5:
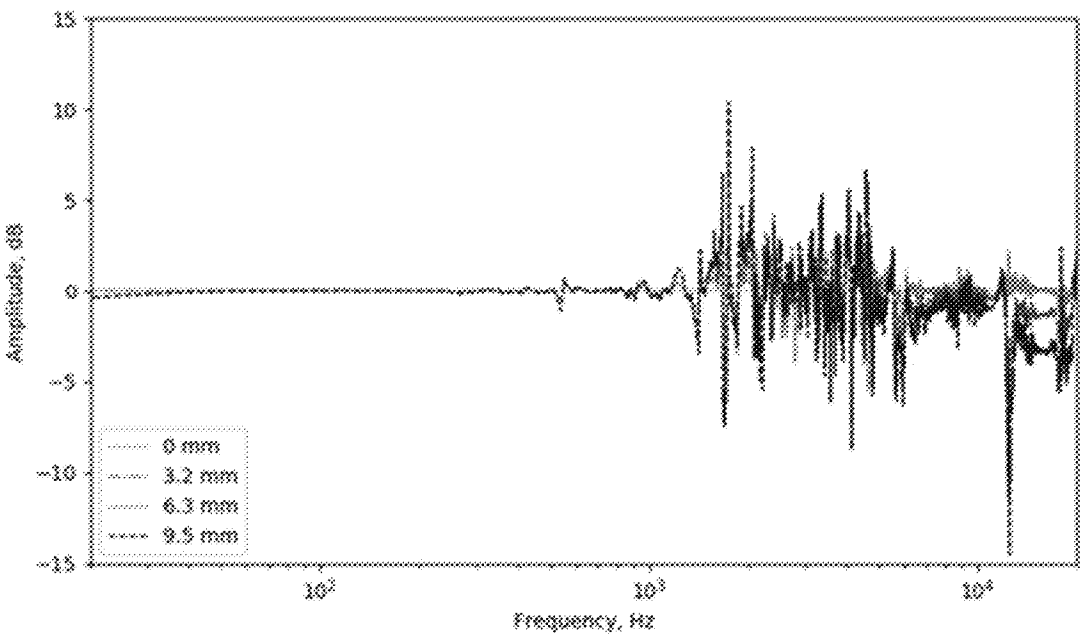
FIG. 5 is a graph illustrating pressure versus position.

In the spatial distribution of pressure was measured within the coupler using the methods described above, Golay sequences of length $2^{19}$ were used. A small microphone was used to sample at high resolution. The Sonion 6297 is a miniature electret condenser microphone for hearing instruments (1 mm diameter, 16.6 $mm^3$ total volume). The microphone was inserted flush with the inside surface of the coupler membrane. The microphone was moved laterally across the membrane incision and 4 measurements were made in increments of 3.175 mm from the center out to 9.525 mm (the radius of the interior cavity is 12.7 mm). Each measurement was processed to yield the impulse response. The pressure amplitude of each position relative to the center position appears in FIG. 5.

As expected, uniform conditions were observed at low frequencies as wavelengths are much longer than the dimensions of the cavity. At low frequencies, the foam is mostly reflective and long wavelengths interact with a cylindrical cavity of dimensions equivalent to the interior space (2.54 cm×2.54 cm). The lack of a rigid backing at the microphone port increases the absorption of the foam at low frequencies and may reduce the influence of resonances somewhat.

Modal activity becomes significant above 1 kHz and the variation in pressure increases with the distance of the measurement point from the center. Each spike in FIG. 5 indicates the change in magnitude of a given standing wave with position. Because a microphone responds to pressure over the diaphragm area, a small microphone will measure more variation than a larger one. While this test identifies non-uniformity of the acoustic field, it largely overestimates the actual variation encountered in practice. When implementing the substitution method, both the test and reference microphones are positioned at the center. If the diaphragms of the test and reference microphone differ in diameter, the edges will be exposed to different sound fields. However, a microphone is usually more sensitive to sound pressure at the center of the diaphragm With some exceptions, the distribution of pressure becomes more uniform at high frequencies above 6 kHz. The density of modes increases rapidly with the frequency of excitation. The damping material reduces the sharpness of resonance and increases the amount of overlap between the modal responses. The cavity can be considered to contain fairly diffuse fields above the Schroeder frequency, which was calculated to be 9.5 kHz using Eq. 1. The reverberation time was 8 ms calculated using Schroeder's backward integration method. While microphone size is not accounted for, the calculated Schroeder frequency roughly corroborates the spatial variation of pressure measurements.

These results underscore the well-known tradeoff between frequency regions of uniform conditions and cavity size. As cavity size decreases, the bandwidth of low frequency region increases while that of the high frequency region decreases. Here, the properties of the damping material introduce a complex interaction. In addition to damping the response at high frequencies, open cell foam helps mediate the tradeoff by decreasing the acoustic volume at low frequencies.

To demonstrate the capabilities of embodiments of the adaptive coupler, the sensitivity of a small microphone of atypical shape was measured. Three Sonion 6297 microphones were measured. Test conditions such as input voltage were attuned to match those specified in the data sheet as possible. A previously calibrated 12.7 mm condenser microphone, the PCB 377B20, served as the reference microphone. For each of the 3 test microphones, four trials of the substitution method were completed to estimate the repeatability of the procedure. The one-third octave band energy of the impulse response was calculated for each measurement. Assuming that $L_p$ was constant for both the test and reference microphones, the overall system sensitivity was calculated according to Eq. (5). Because this is a relative measurement i.e. both the test and reference microphone signals are routed through the same signal chain, the characteristics of the loudspeaker and recording device are not critical. Using the overall system sensitivity, the test microphone sensitivity was calculated per eq. (4). The propagation term was used to counteract the random incidence response correction of the reference microphone.

Considering all possible combinations of the four trials of a given test microphone and the reference microphone yields 16 round-robin combinations.

Figure 6:
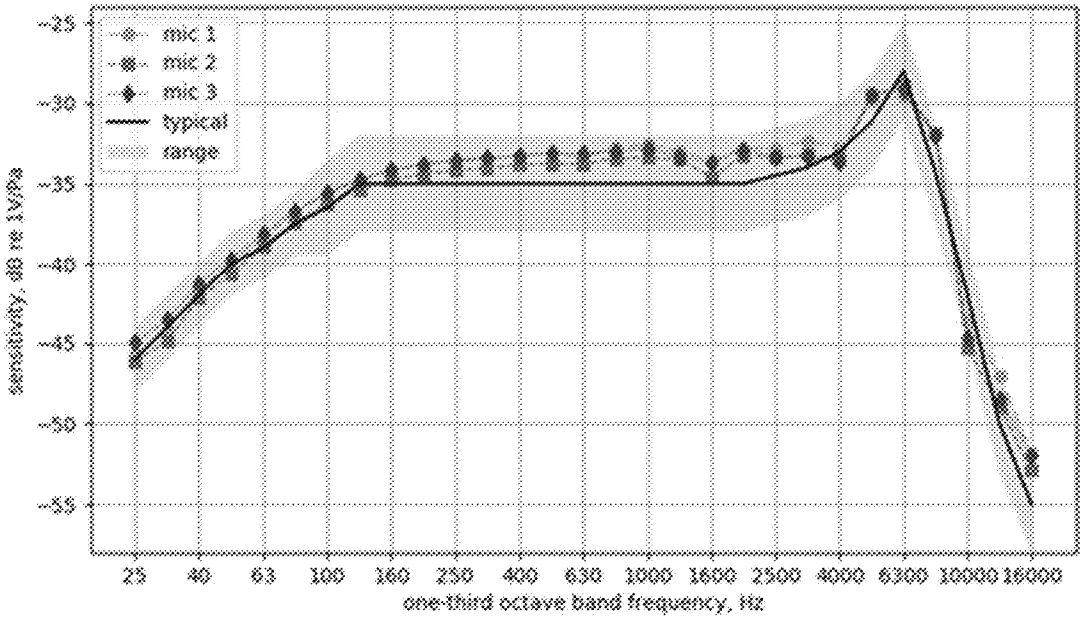
FIG. 6 is a graph illustrating measured average sensitivity of each of the 3 Sonion 6297 microphones.

FIG. 6 shows the average sensitivity over the four trials for each of the three test microphones. The typical sensitivity and range specified by the microphone manufacturer are also shown. To account for differences in the test conditions versus those specified by the manufacturer, corrections were made to the measured microphone sensitivity for load impedance and humidity using the manufacturer's coefficient of sensitivity. The test microphone's sensitivity to temperature and barometric pressure was unknown and not accounted for. The measured sensitivities of all three microphones were consistent with the specifications provided by the manufacturer.

Figure 7:
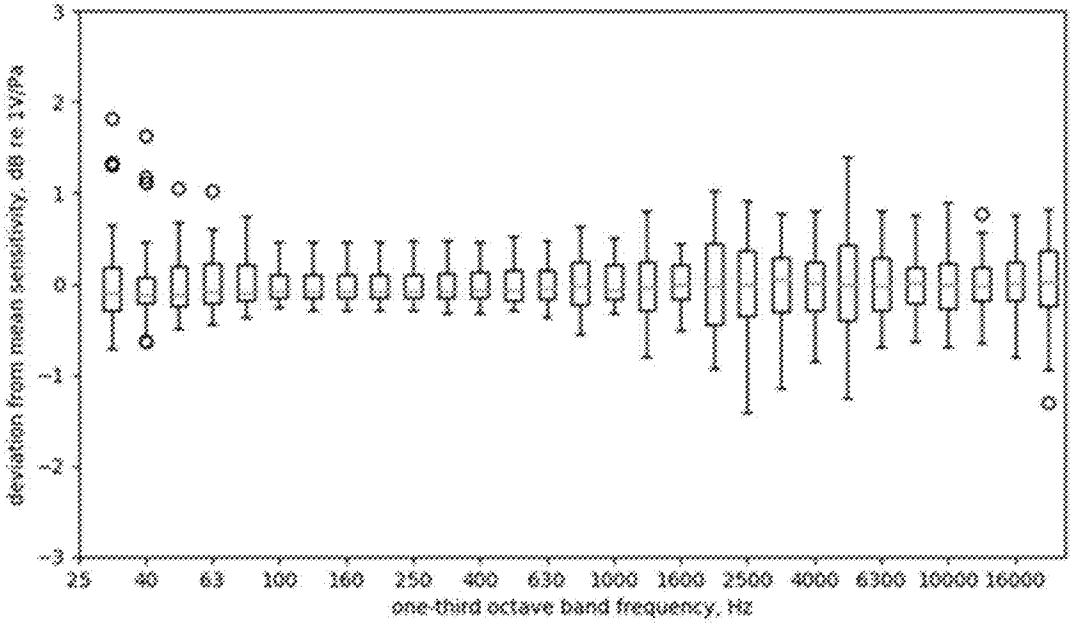
FIG. 7 is a graph that illustrates deviations from the mean sensitivity, aggregated for all three microphones (n=48).

The deviations from the mean sensitivity, aggregated for all three microphones (n=48), are shown in FIG. 7. In general, the magnitude of uncertainty follows the trends observed above due to variation in position. A large component of the uncertainty arises from non-uniformities in the sound pressure distribution inside the coupler due to wave motion, which is exacerbated by slight changes in position. Other sources of uncertainty include variation in environmental conditions, input voltage, source and recording hardware stability, and ambient noise interference. The standard deviation was 0.23 dB at 500 Hz. Note that the standard deviation of the uncertainty between measurements was much less than the differences between the mean sensitivity of the three devices.

CONCLUSION

Calibration of a microphone is necessary to ensure the validity of acoustical measurements, and the quality thereof affects the accuracy of all applications that rely on the resulting data. Conventional closed couplers are specified to work with a limited set of microphones with a particular size and shape required to attain a sealed, closed system. Described herein are embodiments of an acoustical coupler that can readily accommodate a variety of microphone shapes and sizes. To provide context for calibrated measurements and implementation of the substitution method, a generalized system framework was described. The precision and accuracy of the adaptive coupler was demonstrated through calibration of a small, oddly shaped microphone across the sonic frequency range.

It was demonstrated herein that a rigid enclosure and perfect seal is not required to measure the sensitivity of a microphone. However, several tradeoffs were apparent. Signal processing techniques were used to overcome the relatively high transmission loss of an open system. Although the open system relaxed the seal constraint, the received pressure was still sensitive to the fit of the microphone and significant variation was observed at very low frequencies. Non-uniform spatial distribution of pressure was significant at high frequencies due to wave motion, mitigated to some extent by the use of damping material within the coupler. Aggregating the received pressure in one-third octave bands further mitigated the variation; however, this requires the assumption that the narrow-band frequency response of the microphone is smooth within the frequency limits of a given band. The measured uncertainty was greater than standards require for a conventional coupler optimized for use with a standard microphone.

The results presented here were dependent on the specific dimensions of the coupler measured. The anticipation of a wide range of potential microphone sizes required a very large coupler, but it is not necessary for other applications. For example, the shape of a much smaller coupler could be optimized for use with MEMs microphones only; the resulting coupler would operate with less uncertainty over a wider frequency range. Other variations are also possible, such as a rectangular or oval port to measure the sensitivity of the microphone in cellular telephones.

The embodiments of an adaptive coupler described herein may be especially useful for acoustical measurements with consumer audio equipment. While standard sound level meters are well suited for applications requiring high precision, they were developed to address urban noise problems and their cost, power consumption, and limited capabilities constrain the scope of their application. Alternatively, the wide variety of consumer audio equipment offers many options for acoustical monitoring. The ability to make high resolution, multichannel audio recordings with packages that are relatively small, inexpensive, and low power is especially attractive for acoustical monitoring in remote areas and large scale spatial surveys that require many devices. These recordings are more valuable when they are calibrated and processed to yield sound level data.

In the specification and/or figures, the use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Unless otherwise noted, the below references are fully incorporated by reference and made a part hereof:

AIP Handbook of Condenser Microphones: Theory, Calibration and Measurements (Modern Acoustics and Signal Processing) 1995th Edition George S. K. Wong (Editor), Tony F. W. Embleton (Editor)

IEC standard 60268-4, Sound system equipment Part 4: Microphones (International Electrotechnical Commission, 2004).

B. Zhou B and D. Green, "Characterization of external ear impulse responses using Golay codes," J. Acoust. Soc. Am. 92: 1169-1171 (1992).

New Method of Measuring Reverberation Time" [M. R. Schroeder, J. Acoust. Soc. Am. 37, 409-412 (1965)]

ANSI (2009) ANSFASA S1.11-2004 (R2009) Specification For Octave-band And Fractional-octave-band Analog And Digital Filters. American National Standards Institute.

ANSI S1.15-2005/Part 2

American National Standard Measurement Microphones-Part 2: Primary Method for Pressure Calibration of Laboratory Standard Microphones by the Reciprocity Technique Frederiksen, E. "Acoustic metrology—an overview of calibration methods and their uncertainties." International Journal of Metrology and Quality Engineering 4, no. 2 (2013): 97-107.

Wagner, Randall P., and Steven E. Fick. "Pressure reciprocity calibration of a MEMS microphone." The Journal of the Acoustical Society of America 142, no. 3 (2017): EL251-EL257.

Chapter 157. Calibration of pressure and gradient microphones. Victor Nedzelnitsky. Suslick, K. S., L. A. Crum, and M. J. Crocker. "Encyclopedia of acoustics." Crocker MJ: John Wiley & Sons (1997)

M Vorlander, Acoustic Measurements

Müller, Gerhard, and Michael Moser, eds. Handbook of engineering acoustics. Springer Science & Business Media, 2012.

Hughes, William O., Anne M. McNelis, Chris Nottoli, and Eric Wolfram. "Examination of the measurement of absorption using the reverberant room method for highly absorptive acoustic foam." (2015). NASA Technical Report, 29th Aerospace Testing Seminar, October 2015

Kinsler, L. E., Frey, A. R., Coppens, A. B. and Sanders, J. V., 1999. Fundamentals of acoustics. Fundamentals of Acoustics, 4th Edition, by Lawrence E. Kinsler, Austin R. Frey, Alan B. Coppens, James V. Sanders, ISBN 0-471-84789-5. Wiley-VCH, December 1999.

What is claimed is:

1. An adaptive coupler for calibration of arbitrarily shaped microphones, said adaptive coupler comprising:

a rigid structure having proximal and distal ends, wherein the rigid structure is at least partially hollow; and a flexible membrane located within the proximal end of the rigid structure, wherein said flexible membrane adapts to a shape of a microphone inserted into an opening in the flexible membrane, wherein at least a portion of the microphone is exposed to the hollow portion of the rigid structure, wherein the rigid structure is configured to receive sound pressure from a sound source into its hollow portion.

2. The adaptive coupler of claim 1, wherein the rigid structure receives the sound pressure predominately at its distal end and the distal end has at least one opening to receive the sound pressure from the sound source.

3. The adaptive coupler of claim 1, wherein the flexible membrane comprises an adaptive material.

4. The adaptive coupler of claim 1, wherein the rigid structure has a length, said length forming a space between the flexible membrane and the distal end.

5. The adaptive coupler of claim 4, wherein the space is a gas-filled space and/or the space is at least partially filled with a sound-absorbing material.

6. The adaptive coupler of claim 4, wherein the microphone is inserted into the opening in the flexible membrane such that a distance is formed between an end of the microphone and the sound source, said distance less than or equal to the length.

7. The adaptive coupler of claim 4, further comprising a conduit, wherein the conduit extends from the sound source into the space.

8. The adaptive coupler of claim 1, further comprising a reference microphone located within the rigid structure.

9. A method of calibration a microphone using an adaptive coupler, said method comprising:

providing an adaptive coupler, said adaptive coupler comprising a rigid structure having proximal and distal ends and a flexible membrane located within the proximal end of the rigid structure, said rigid structure is at least partially hollow, wherein said flexible membrane adapts to a shape of a microphone inserted into an opening in the flexible membrane, wherein the rigid structure is configured to receive sound pressure into its hollow portion from a sound source;

inserting a microphone to be calibrated into the opening in the flexible membrane;

applying sound pressure to the microphone to be calibrated using a sound source located proximate to the adaptive coupler;

determining a response of the microphone to be calibrated to the applied sound pressure;

determining a response of a calibrated microphone to the applied sound pressure;

comparing the response of the microphone to be calibrated to the response from the calibrated microphone; and calibrating the microphone to be calibrated based on any differences between the response of the microphone to be calibrated to the response from the calibrated microphone.

10. The method of claim 9, wherein the microphone to be calibrated has an irregular shape.

11. The method of claim 9, wherein determining the response of the calibrated microphone to the applied sound pressure comprises concurrently applying the sound pressure to the microphone to be calibrated and the calibrated microphone.

12. The method of claim 11, wherein the calibrated microphone is located within the rigid structure when the sound pressure is applied to the microphone to be calibrated and the calibrated microphone.

13. The method of claim 11, wherein determining the response of the microphone to be calibrated to the applied sound pressure and determining the response of a calibrated microphone to the applied sound pressure comprises sequentially inserting the microphone to be calibrated into the opening in the flexible membrane; applying the sound pressure to the microphone to be calibrated; determining the response of the microphone to be calibrated; removing the microphone to be calibrated from the opening in the flexible membrane; inserting the calibrated microphone into the opening in the flexible membrane; applying the sound pressure to the calibrated microphone; and determining the response of the calibrated microphone.

14. The method of claim 9, wherein the flexible membrane comprises adaptive material.

15. The method of claim 9, wherein the rigid structure has a length, said length forming a space between the flexible membrane and the distal end.

16. The method of claim 15, wherein the space is a gas-filled space and/or the space is at least partially filled with a sound-absorbing material.

17. The method of claim 15, wherein the microphone is inserted into the opening in the flexible membrane such that a distance is formed between an end of the microphone and the sound source, said distance less than or equal to the length.

18. The method of claim 15, further comprising a conduit, wherein the conduit extends from the sound source into the space.

19. The method of claim 9, wherein the rigid structure has a cross-sectional area, and the distal end is configured to receive sound pressure from the sound source through an opening in the distal end, said opening having an area that is less than the cross-sectional area of the rigid structure.

20. The method of claim 9, wherein the rigid structure has a cross-sectional area, and the microphone is inserted into the opening in the flexible membrane through an opening in the proximal end, said opening having an area that is less than the cross-sectional area of the rigid structure.

* * * * *